US006082944A

United States Patent [19]

Bachmann et al.

[11] Patent Number: 6,082,944

[45] Date of Patent: Jul. 4, 2000

[54] RESEALABLE BEVERAGE CONTAINER AND TOP THEREFOR

[75] Inventors: Henry C. Bachmann, Dayton; Steven T. Cook, Bellbrook; James R. Schubert; John F. Schubert, both of Dayton; Lori E. Strong, Huber Heights, all of Ohio

[73] Assignee: Dayton Systems Group, Inc., Dayton, Ohio

[21] Appl. No.: 09/240,841

[22] Filed: Jan. 25, 1999

Related U.S. Application Data

[62] Division of application No. 08/971,523, Nov. 17, 1997, Pat. No. 6,015,062

[60] Provisional application No. 60/031,119, Nov. 18, 1996.

[51] Int. Cl.[7] ..... B21D 51/46; B21D 51/50

[52] U.S. Cl. ..... 413/22; 413/8; 413/24; 413/56; 413/62

[58] Field of Search ..... 413/24, 23, 22, 413/8, 9, 6, 26, 62, 58, 56, 53, 4; 72/348, 349, 379.4; 53/487, 488, 490, 317, 331.5; 220/254, 288, 293, 295, 296, 304, 601, 614, 619, 906

[56] References Cited

U.S. PATENT DOCUMENTS

| | | | |
|---|---|---|---|
| 1,543,053 | 6/1925 | Buschman | 220/304 |
| 1,802,898 | 4/1931 | Hothersall | 220/304 |
| 2,148,169 | 2/1939 | Merolle | 413/24 X |
| 2,339,763 | 1/1944 | Calleson et al. | 220/906 X |
| 2,426,550 | 8/1947 | Coyle | 220/906 X |
| 3,338,200 | 8/1967 | Patton | 413/24 |
| 3,374,601 | 3/1968 | White | 53/490 X |
| 3,580,201 | 5/1971 | Vercillo | 413/24 X |
| 3,844,443 | 10/1974 | Cudzik | 220/304 X |
| 4,202,462 | 5/1980 | Imber | 220/295 X |
| 4,413,497 | 11/1983 | Kubis et al. | 72/348 X |
| 4,979,350 | 12/1990 | Arnemann | 53/331.5 |
| 5,322,177 | 6/1994 | Coggings | 220/304 X |

FOREIGN PATENT DOCUMENTS

| | | | |
|---|---|---|---|
| 633497 | 1/1928 | France | 220/906 |
| 799649 | 6/1936 | France | 220/906 |
| 458853 | 3/1951 | Italy | 220/906 |

*Primary Examiner*—James F. Coan
*Attorney, Agent, or Firm*—Joseph G. Nauman

[57] ABSTRACT

A resealable can end is provided including a neck member and hat member which can be sealed onto and removed from the neck member of the end, and is capable of containing product under pressure if desired. This end can be added, as by a conventional seam, to a metal container body to obtain resealing containment of partial contents retained in the container, and to provide an improved mouth construction (or pour opening) for better pouring and for comfortable direct drinking from the container. Also disclosed are improved methods of and apparatus for making such a resealable hat and-neck type-of container end.

3 Claims, 14 Drawing Sheets

RESEALABLE BEVERAGE CONTAINER AND TOP THEREFOR

CROSS-REFERENCE TO RELATED APPLICATION

This application is a division of U.S. patent application Ser. No. 08/971,523 filed Nov. 17, 1997, and now U.S. Pat. No. 6,015,062.

RELATED APPLICATION

This application is based upon provisional U.S. application Ser. No. 60\031,119 filed Nov. 18, 1996.

BACKGROUND OF THE INVENTION

This invention relates to containers for liquids, particularly beverages, which include a reclosable top or cap, and which can be applied to various standard types of cans and the like by use of known interlock curl attachment systems.

The current known forms of easy open container end, using a tear-open pour panel operated by an integral or "attached" tab, while universally acceptable in more affluent societies, particularly in the beer/beverage market, is somewhat of a luxury convenience item. These can be recycled insofar as they are constructed primarily of aluminum, but despite many efforts a successful reclosable device or mechanism, particularly one built into the original container, has not been given favor in the marketplace, for a number of reasons. Such containers have thus been relegated to use as one time, throw-away packaging, and they are not capable of keeping fluid contents secure while permitting intermittent partial dispensing of the contents after initial opening.

Prior to, and during the introduction of, easy-open can ends, a form of container was available having a generally frusto-conical top on a can body and provided with a non-reclosable crown-type cap. Some of those even had a separate reclosable cover threaded to a neck and covering the crown-type cap which was to be discarded once opened, as typified by the disclosure in U.S. Pat. No. 2,337,616. These containers, for various reasons, failed to maintain market acceptance.

Thus, there is still a need for a reclosable container for fluids which, as part of the original container construction or assemblage, can be reclosed to retain part of the contents under sealed conditions. The mouth construction of such containers is also more acceptable than easy-open containers for direct drinking of the container contents.

Such a reclosable feature has become available in plastic (non-metallic) containers (ordinarily blow-molded) for carbonated beverages, in both two liter and smaller one-half liter (0.59 ml) sizes. Such containers have a frangible sealed and resealable screw-on cap molded of a suitable plastic, but loss of carbonation through the plastic body materials, resulting in lower shelf life of the product and difficulty in recycling same has impaired widespread acceptance of such plastic containers.

Thus, there is a marketplace need for containers for fluids, and particularly liquids under pressure (e.g. the beer/beverage containers) which have the reclosable feature and which can be constructed of metal, preferably aluminum.

SUMMARY OF THE INVENTION

The present invention provides a closure construction for reclosable metal containers, e.g. for a metal can body, wherein a domed container end with a neck portion having a pour opening is provided with a reclosable metal type of cap or hat. Preferably, the end, with an attached sealed hat, is attached to the open end of a filled can by a conventional double rolled seam connection. The invention also encompasses methods of making and attaching such ends to a can body.

The invention provides a unique and versatile container for fluids, particularly for beverages, wherein various standard can bodies are provided with an end including a neck with a pour opening, a lug formation on the neck below the pour opening, a reclosable cap or hat having a lug formation which can interlock with the lug formation on the neck and including a seal surrounding the pour opening, and thus capable of maintaining product under pressure. The end preferably is coupled to a can body by conventional double rolled seam attachment between the bottom of the neck and the rim of the can body.

The principal object of this invention is to provide a resealable end including a removable cap construction (also called a neck and hat herein) which can be added, such as by a conventional seam, to a metal container body to obtain resealing containment of partial contents retained in the container, even under pressure, and to provide an improved mouth construction (or pour opening) for better pouring and for comfortable direct drinking from the container; and to provide improved methods of and apparatus for making such a resealable hat and neck.

Other objects and advantages of the invention will be apparent from the following description, the accompanying drawings and the appended claims.

DESCRIPTION OF THE PREFERRED EMBODIMENT

Figure 1:
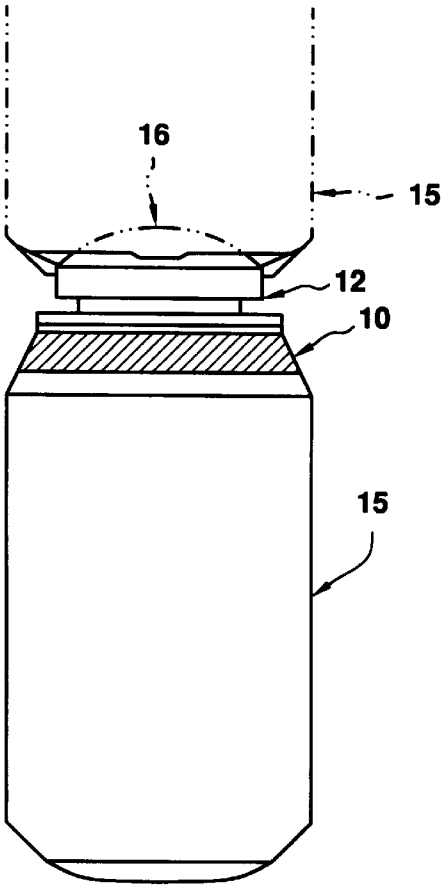
FIG. 1 is a view showing, in outline, two stacked containers incorporating the invention, the uppermost container shown in phantom lines.

The container end of the present invention is comprised of two major parts, a dome structure 10 and a cap or hat member 12 which is in the general form of an inverted cup, including an outwardly curled rim 13 depending from the top panel 14 of hat member 12. In FIG. 1, a pair of containers including can type bodies 15 each provided with this end, such bodies having a concave central portion 16 in their bottoms are shown stacked one upon the other to demonstrate the ability of the container to be so stacked while including the novel resealable end. Such bottom configuration of can bodies is per se known.

Figure 2A:
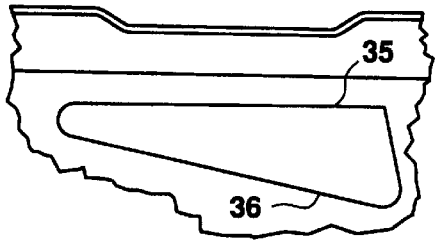
FIG. 2A is an enlarged detail view of one of the lugs formed outwardly in the upper neck section of the end.
Figure 2:
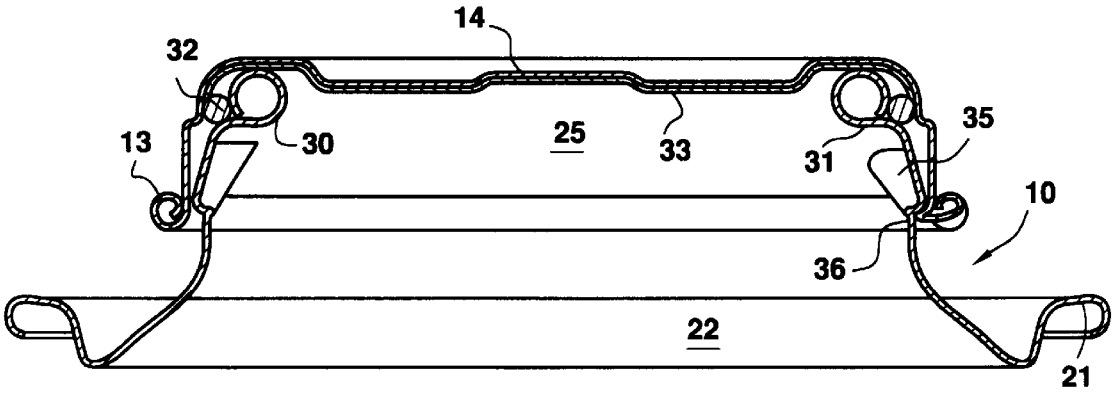
FIG. 2 is an enlarged cross-sectional view of a container end constructed according to the invention, including the rim at the lower edge of the neck section which becomes part of a seamed joint between the end and the upper rim of a can body.

Referring to FIG. 2, the dome includes a neck structure 11 with a wing-like lower rim 20 capable of being seamed to the upper end or rim of a can body (see the left edge of FIG. 2), and optionally including a sealing compound 21 on the underside of rim 20. Rim 20 extends outward from the lower edge of a generally frusto-conical central neck section 22 which has formed on its upper edge a generally cylindrical upper neck section 25 which terminates at its upper edge in a outward curled seal rim 30 formed upon a ledge 31. About seal rim 30 there is shown an elastomeric preferably circular seal 32, which may take different forms as later explained, but in general is fitted within cap 12.

Extending outward from upper neck section 25 are a first set of elongated lugs 35, generally triangular in shape (see FIG. 2A), with angled lower cam surfaces 35C extending at a predetermined angle to the generally vertical outer surface of neck section 25. These lugs 35 cooperate with a second set of inwardly extending lug members 36 formed in the curled rim 13 of hat member 12 to hold the cap firmly on the dome structure, as later explained. When the hat member is attached to the upper neck portion, the cooperating first and second lug members 35, 36 draw top panel 14 against the curled seal rim 30, and compress seal 32 against the curled rim 30 and ledge 31, as shown in FIG. 2.

Seal 32 can take different forms. In a first form the annular O-ring type seal is molded as a peripheral part of a thin flexible and compliant disk 33 which is attached to the underside of top panel 14. In another form, the O-ring type seal is made as a rim of a circular thin member which is applied to the outer portion of the underside of top panel 14. In any event, the compressible elastomeric seal member is positioned within the hat member 12, as shown in FIG. 2. This arrangement will retain initial pressurization of product (if necessary), and hold residual pressure after reclosing.

Tooling

The tooling which is disclosed herein is intended for use in reciprocating high speed presses, although other forms of tooling and actuation are within the scope of the invention. In general, with regard to FIGS. 3A–B and FIGS. 5A–B, a typical press includes an upper die plate UP, a lower die plate LP, and guide posts GP which maintain the alignment of a punch or punches on upper plate UP and a corresponding die or dies on lower plate LP. The various ones of these figures represent, in somewhat schematic fashion, the tooling at different stations within a press.

Hat Formation

FIGS. 3A–B and 4A–B show the hat or cap and the two steps of forming the completed lugged hat 12. Both steps may be contained in the same press, as this is convenient in a high production environment, however the second operation can be performed in an auxiliary piece of equipment.

Figure 3A:
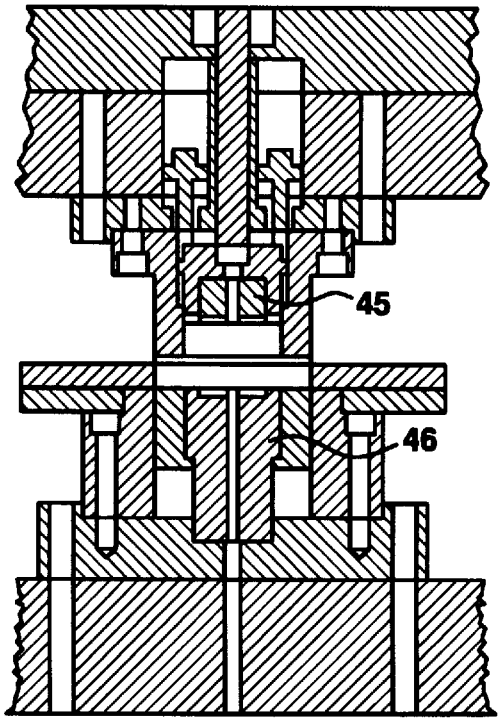
FIGS 3A, 3B and 3C are progressive cross-section views illustrating operations in forming of the hat or cap portion of the novel container end.
Figure 3C:
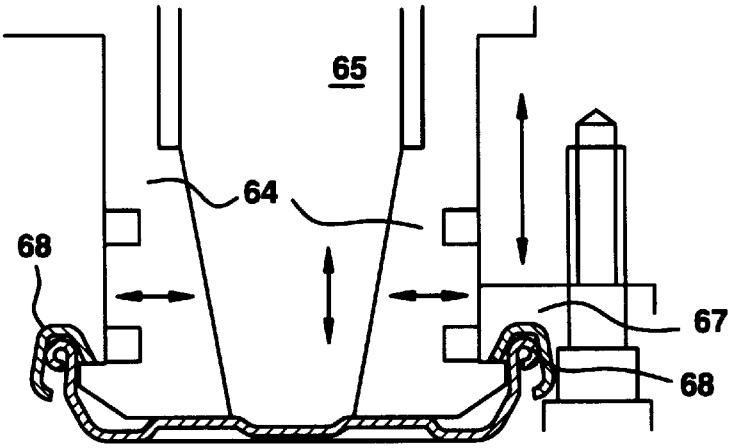
Figure 3B:
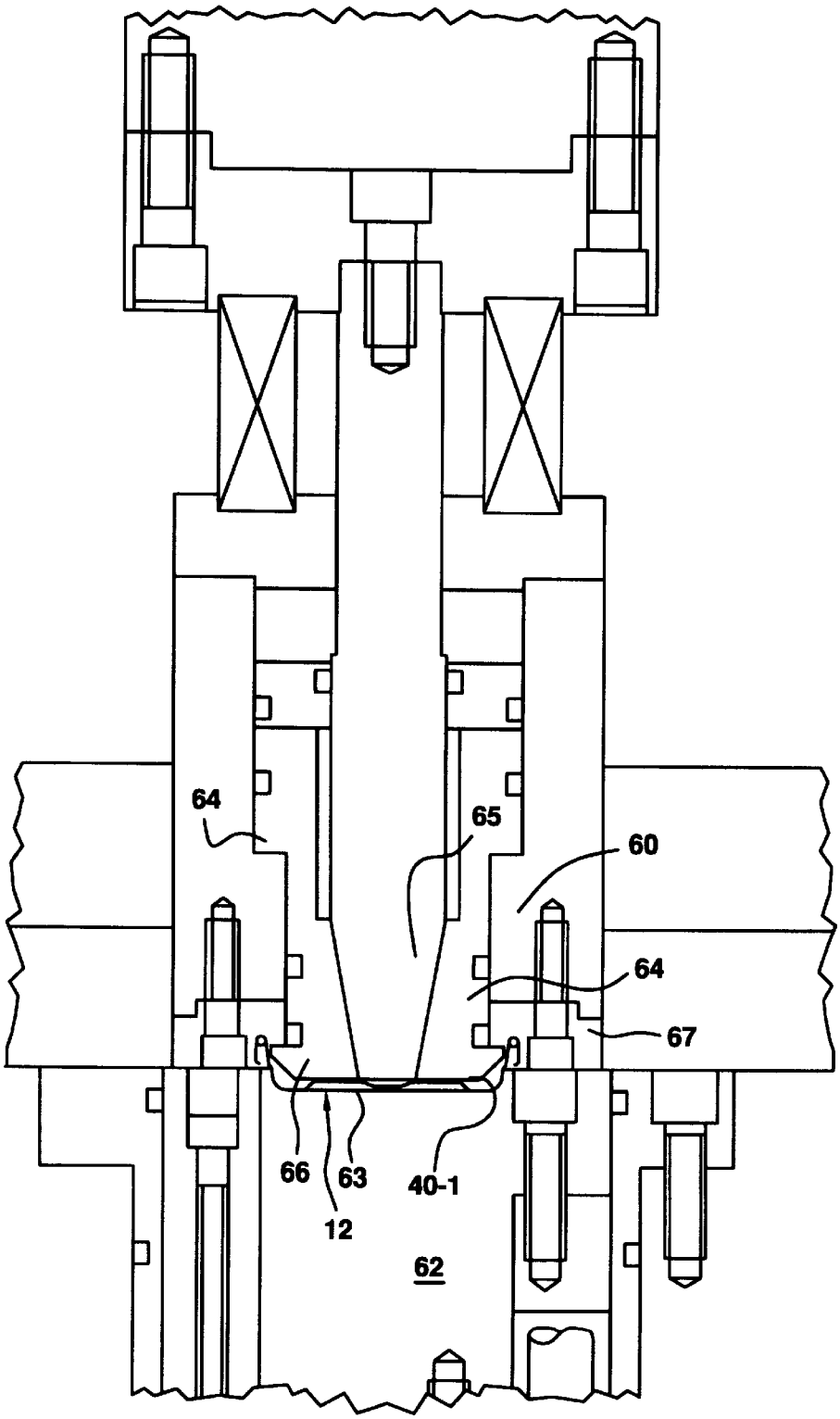

In the first operation (at a first station I-H), a blank is cut from either sheet or coiled material on the down stroke of the press by blank punch 45. On the continuation of the down stroke, the blank is drawn into a cup shaped hat part 40-1. At the bottom of the stroke the panel shape 42 is formed into the top of the hat part 40-1 by the punch 45 and cooperating die 46 (FIG. 3A).

Figure 4A:
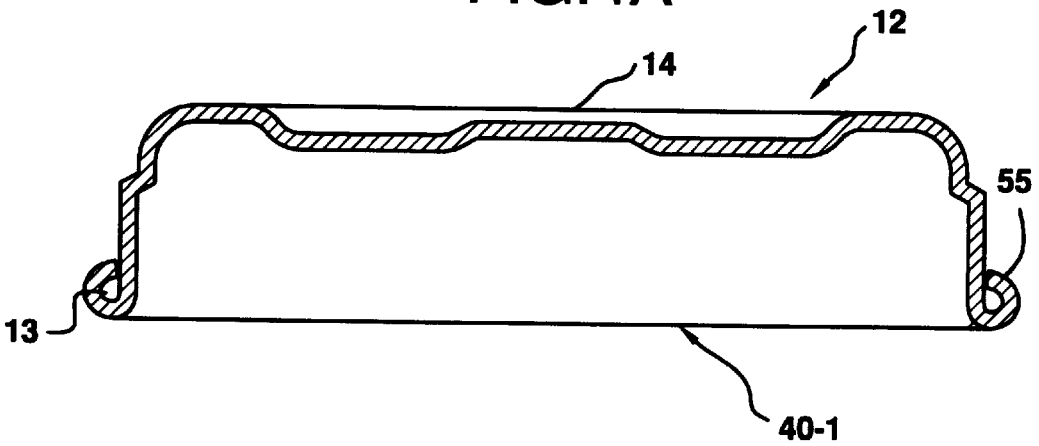
FIGS. 4A–B are progressive cross-section views of the hat member illustrating its formation.
Figure 4B:
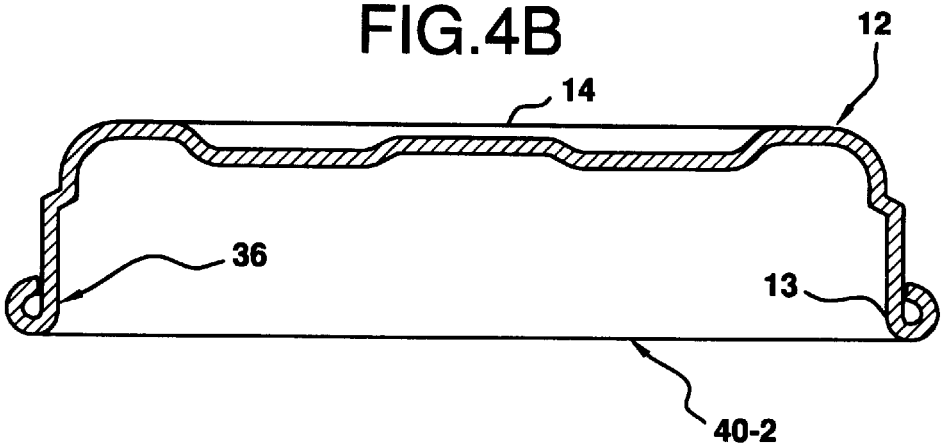

On the up stroke, the lower curl ring 48, which is under spring pressure, raises-with the blank punch. The edge 50 of the hat part 40-1 is curled outward into the cavity formed by curl ring 48 and blank punch 45, thus completing a formed hat or cap part 40-1 with an outside curl 55, as shown in FIG. 4A.

In the second operation (which as mentioned can be another station in the press or in an auxiliary piece of equipment), at a second station II-H there are a punch 60 and die 62 having a cavity which receives the hat part 40-1 in an inverted-orientation with the outside curl 55 resting in a cavity 63 in die 62. A punch probe, comprising a plurality (e.g. three or four) of radially movable fingers 64 cooperating with a central tapered actuating cam 65, is inserted first into the product side (interior) of the formed hat part 40-1 before the punch closes against the hat part 40-1. The fingers 64 are extended by cam 65 (to the position shown in FIG. 4B) and the finger ends 66 extend into the hat part 40-1 against the interior of curl 55 to establish the height of the lugs 36 to be formed from material of curl 55. A curling ring 67 on the punch has a set of cavities in its radially inward section, these corresponding to the location and size of the lugs 36. The radially outward region of ring 67 has corresponding inward extending surfaces 68 which move material from the outside curl 55 toward the inside of the hat part 40-1, as the curling ring 67 bottoms out over finger ends 66. This will establish the final form of hat part 40-2, including inwardly directed lugs 36 (preferably three or four) above the outward curled edge 50.

Neck Structure Formation

The neck/dome structure 11 is formed in seven operations as described hereafter. However the first station Blank & Draw operation and the second station Redraw operation can if desired, be combined into a single station, reducing the total number of stations to six. The following description will assume that the first and second stations are separate.

Figure 5A:
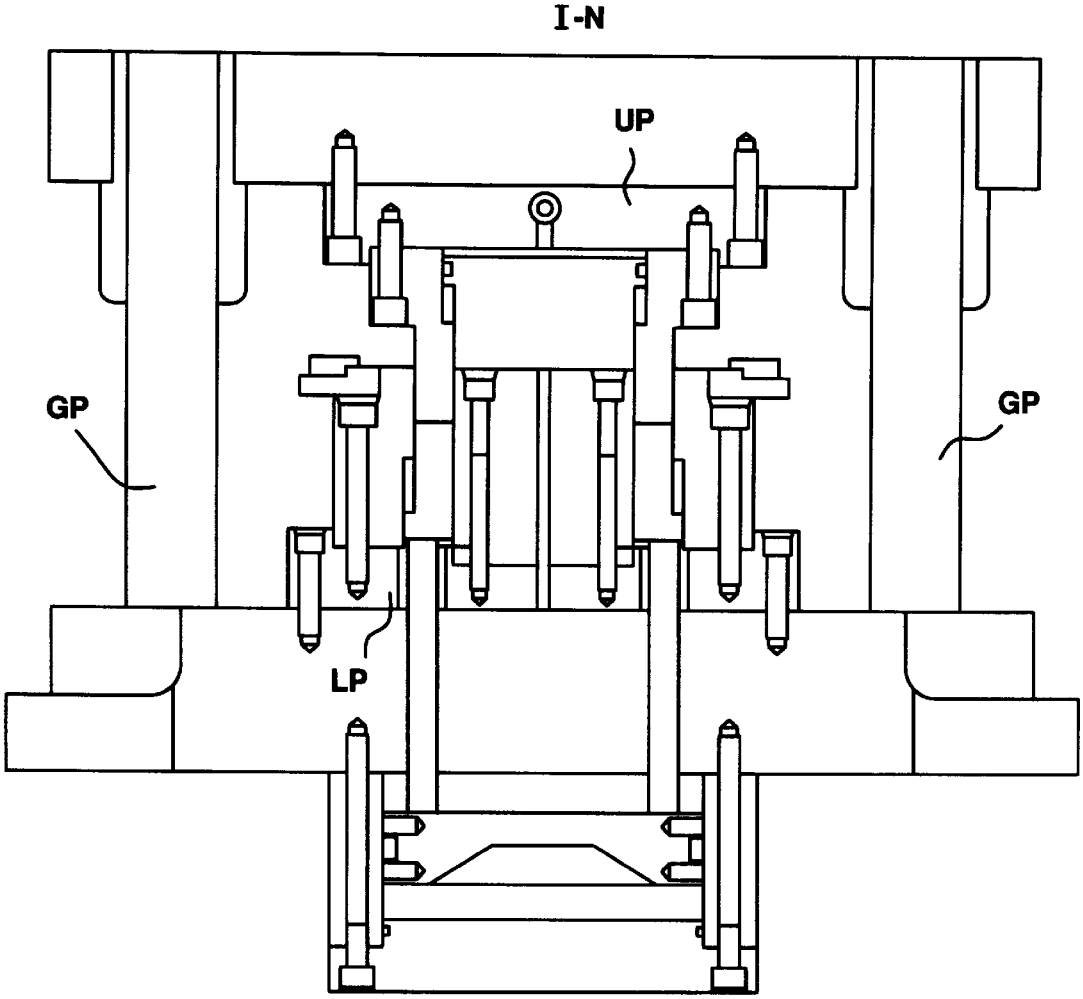
FIGS. 5A–H are partial cross-section views of punch and die tools in a typical press environment, illustrating the formation of the dome or neck structure of the container end.
Figure 6A:
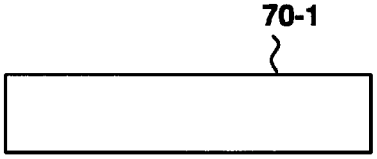
FIGS. 6A–G are enlarged cross-section views of the progressive formation of the neck structure.
Figure 6B:
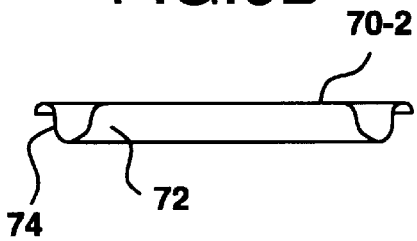
Figure 6C:
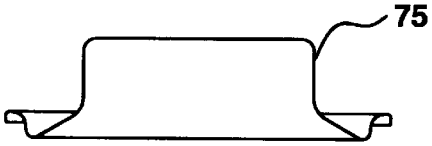

At the first station I-N, a blank is cut from either sheet or coiled material, and is drawn into a cup shaped part 70-1, as shown in FIGS. 5A & 6A.

At the second station II-N, the part 70-1 is redrawn to form the countersink area 72 and the edge 74 is curled to establish the final outside diameter. This allows the resultant part 70-2 to be placed into a belt type transfer system from this operation onward, enabling higher production speeds than can be achieved with other forms of transfer systems. It will be appreciated that the first and second stations can remain separate, however in a production atmosphere that would incorporate an automated transfer system, it may be preferred that stations I-N & II-N be combined to allow immediate placement of the parts into a belt, or other similar transfer system.

Figure 5B:
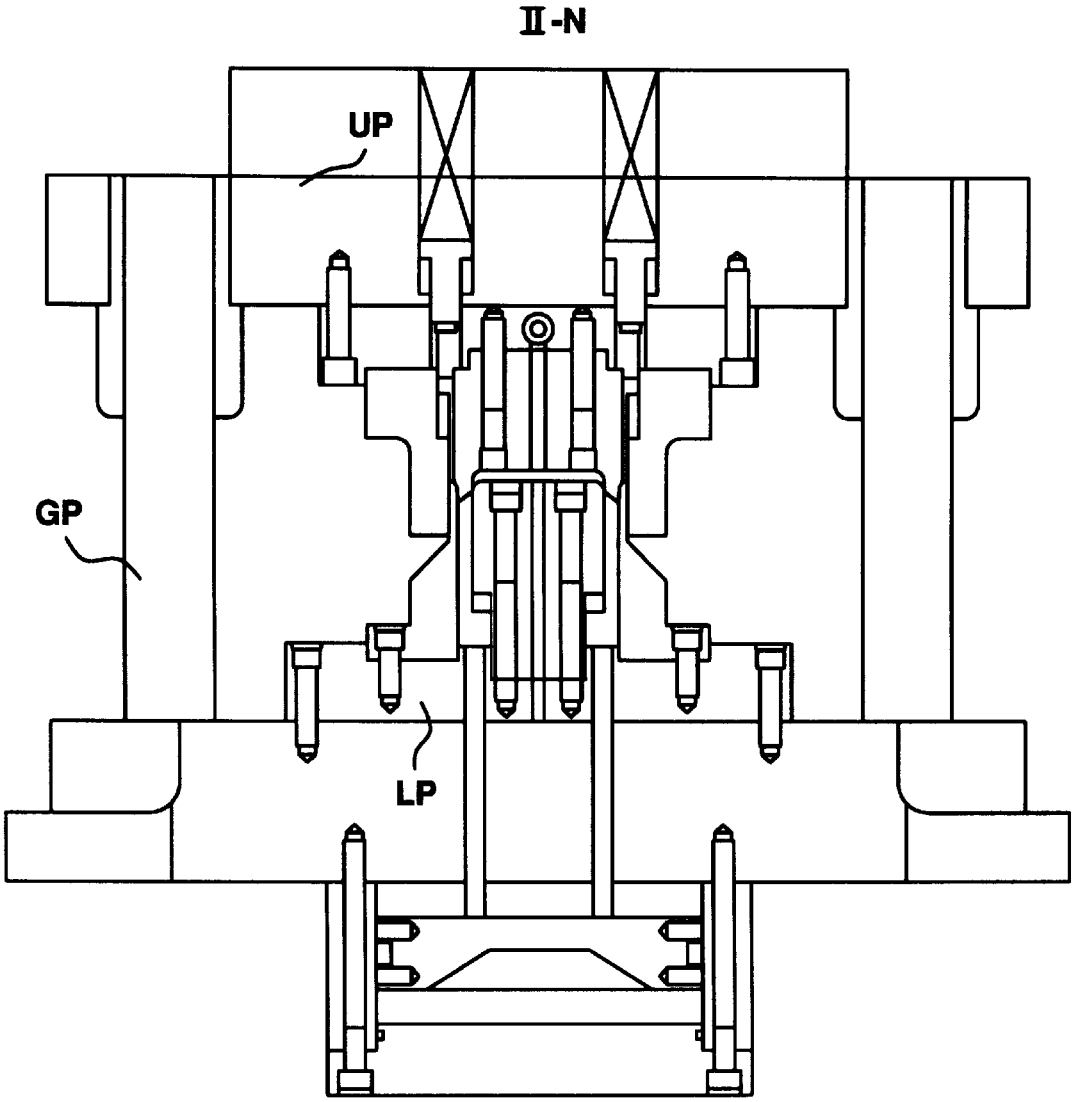
Figure 5C:
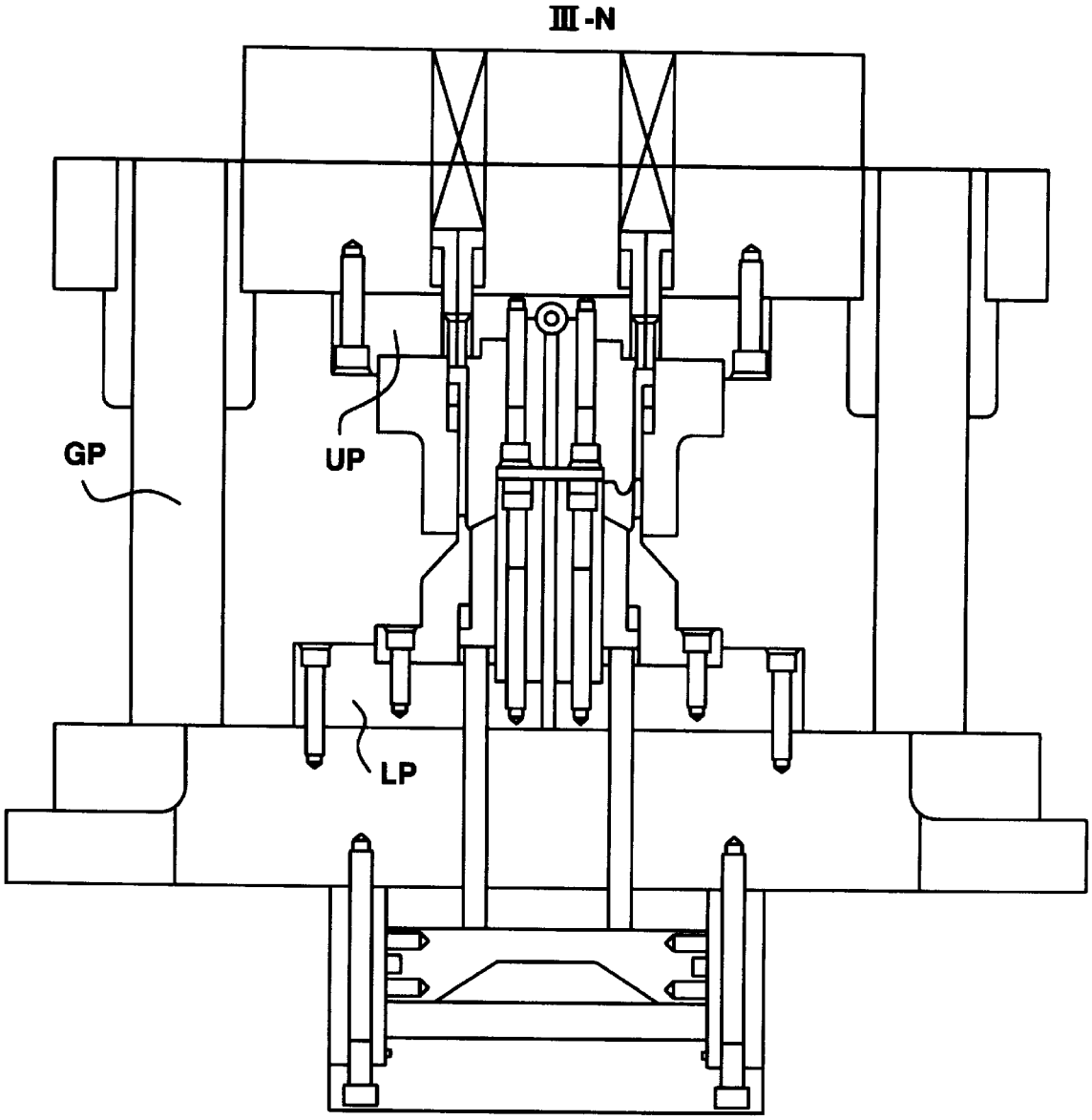
Figure 5D:
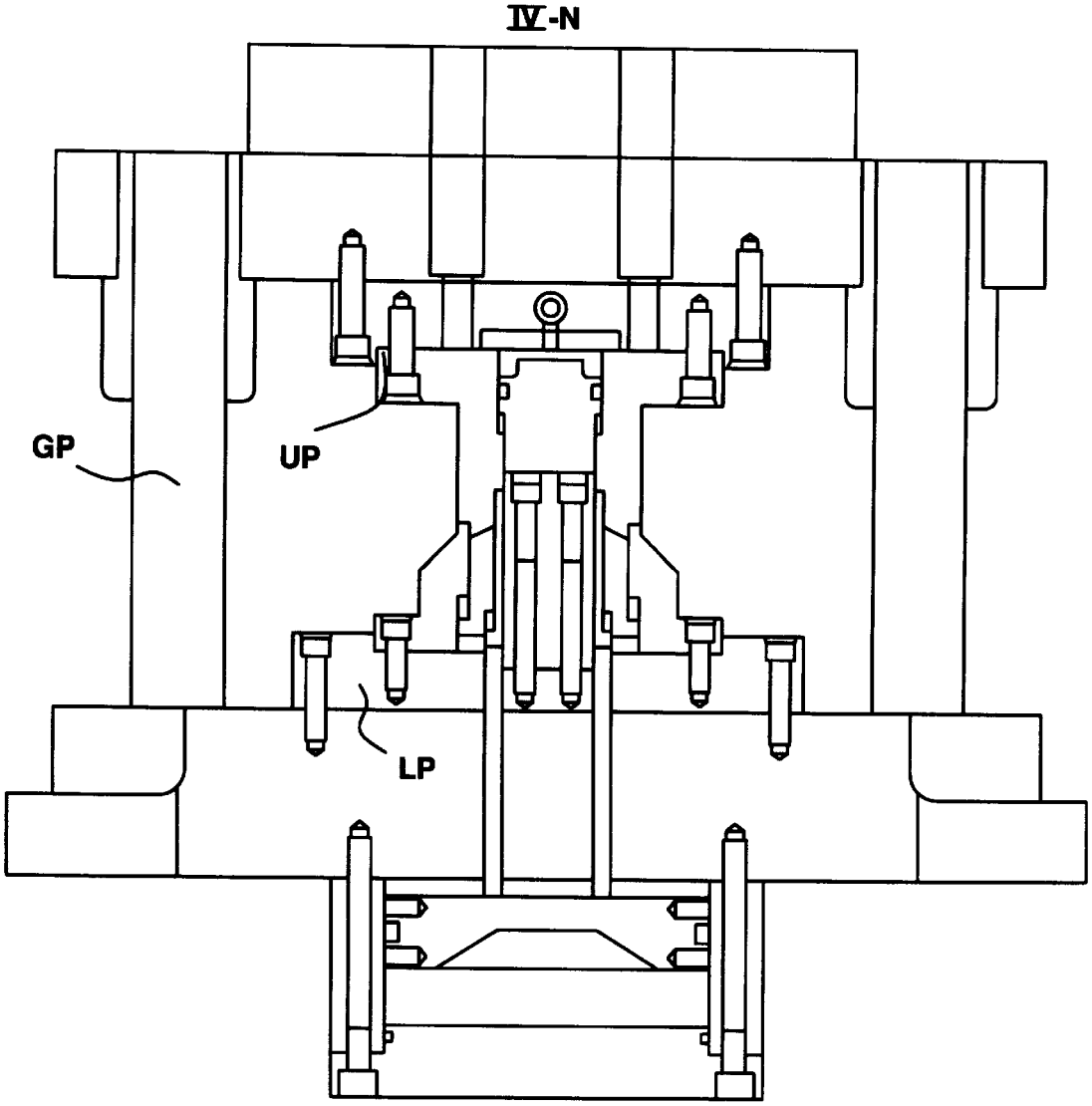
Figure 6D:
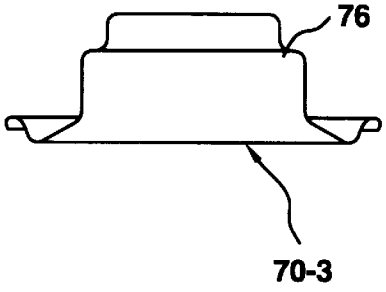
Figure 5E:
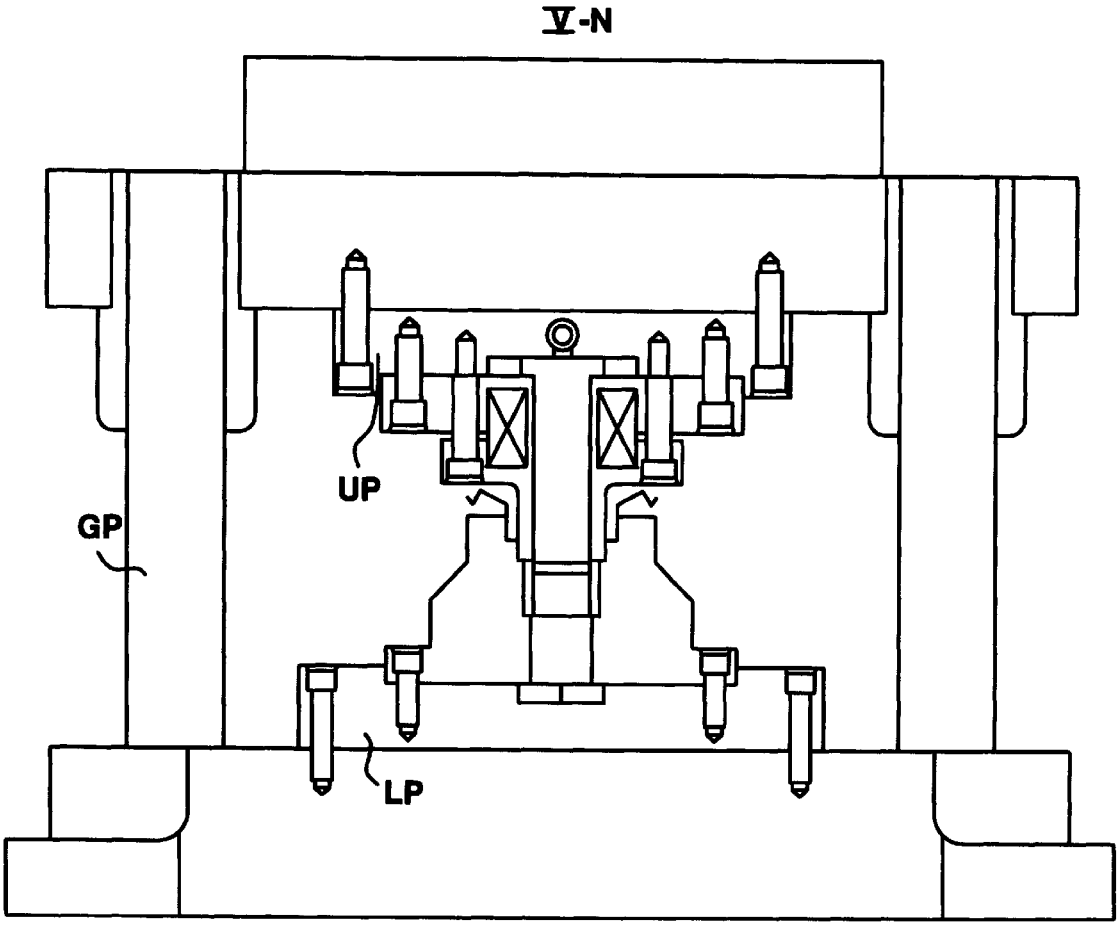
Figure 6E:
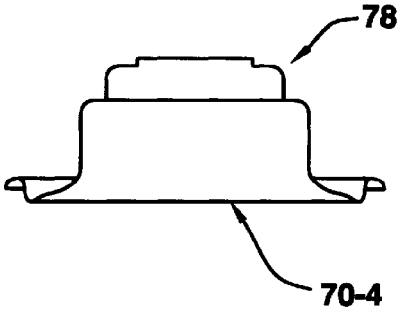
Figure 5F:
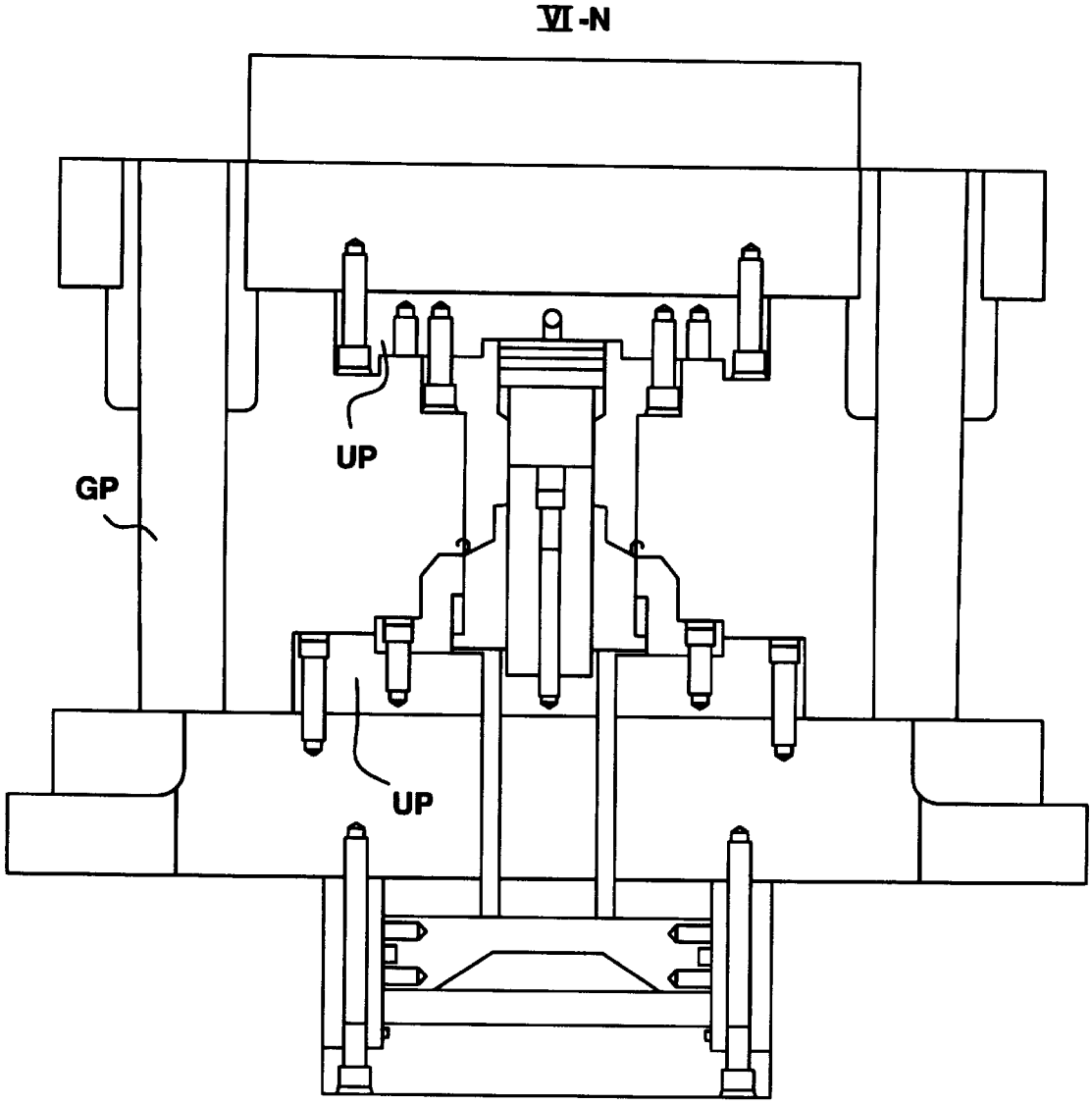

At the third station III-N, part 70-2 is redrawn to obtain additional height of the central section 75, and in the fourth station IV-N a lip 76 is formed, upon which the curl (formed in the seventh operation, as later described) will rest, resulting in part 70-3 (FIGS. 5D & 6D).

Figure 6F:
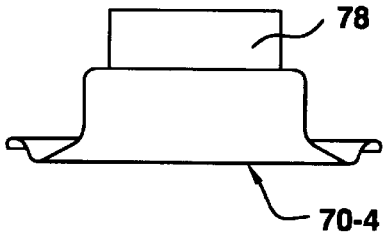
Figure 5G:
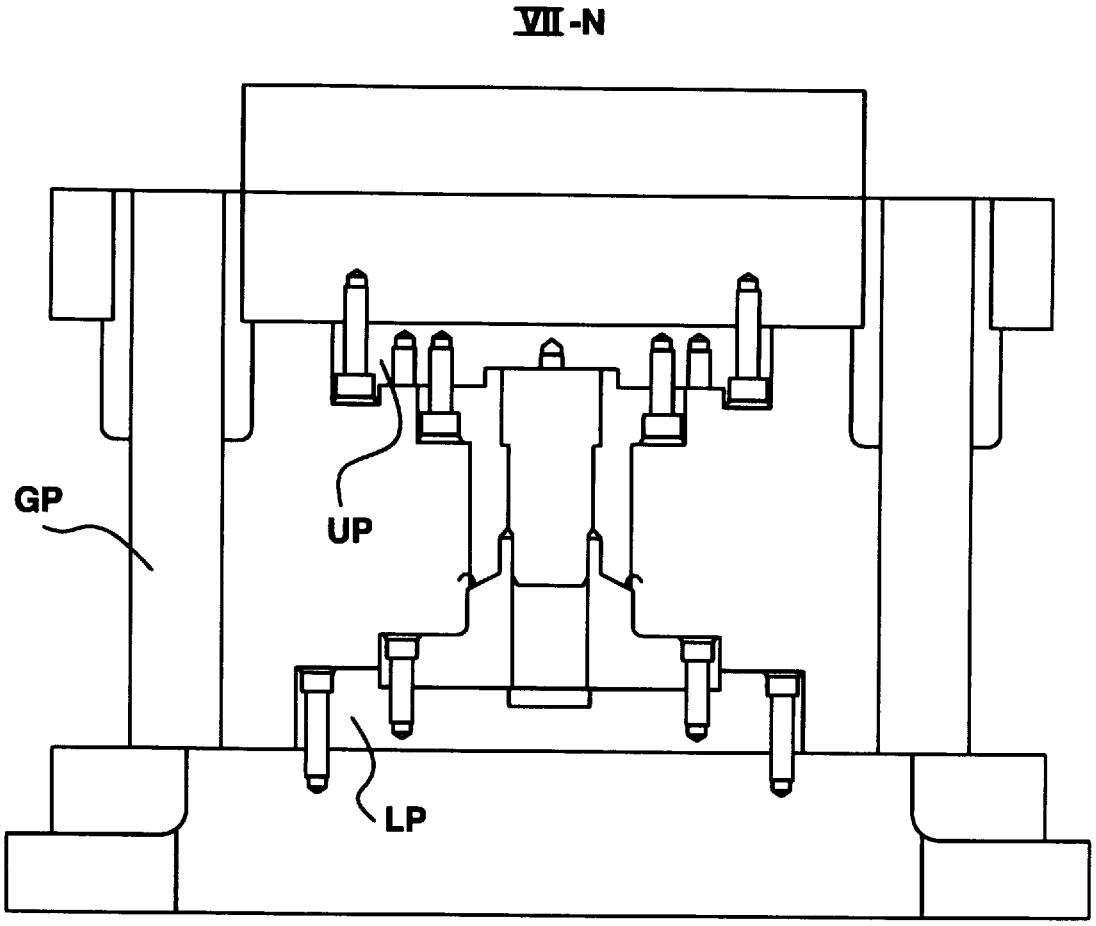

In the fifth station V-N, a hole or opening 78 is pierced through the part, and in the sixth station VI-N opening 78 is extruded upward to obtain the material necessary for the curl on part 70-4 (see FIG. 6F).

Figure 6G:
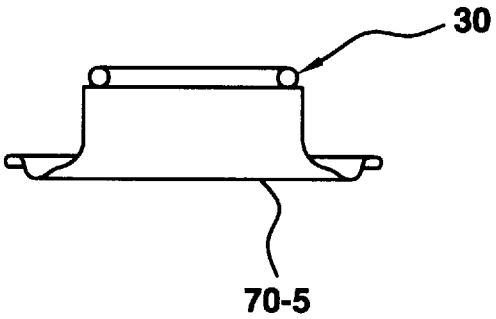
Figure 5H:
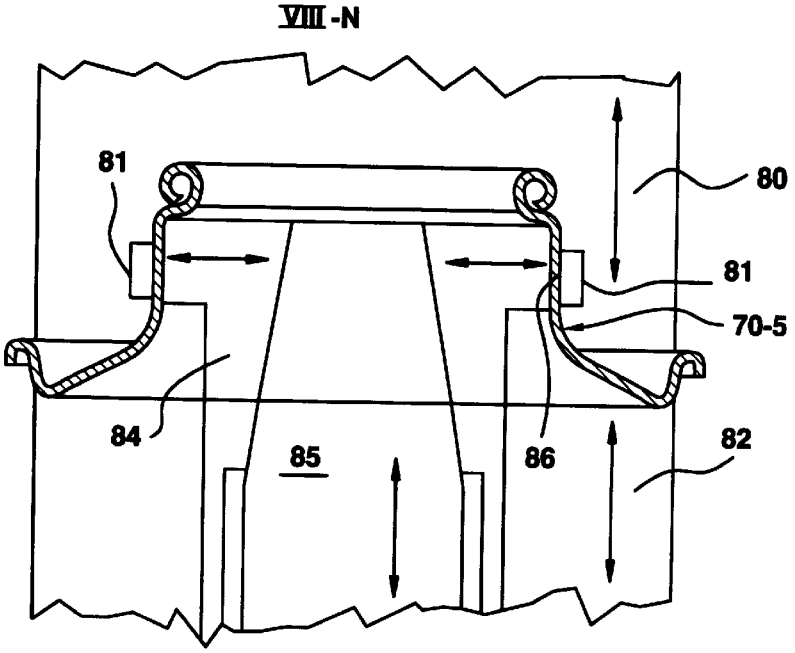

Then, in the seventh station VII-N the curled seal rim 30 around the drinking opening is formed. The curl is formed through 360 degrees so the raw edge of the material cannot come in contact with the user's mouth when drinking directly from the container. This results in the part 70-5 (shown in FIG. 6G).

The lugs 35 can be added to the upper neck section 25 in a further press station. It is also possible to form such lugs in separate auxiliary equipment which employs the technique of rolling threads or the like in thin-walled metal cylindrical or cup shaped parts.

In the additional press station VIII-N the part 70-5 is placed in a die member 80 which includes cavities 81 corresponding to the desired external configuration and location of the lugs 35. In a preferred embodiment there will be three or four such cavities (as before), which will be aligned around the upper neck section at the desired location of the lugs 35. A punch, 82 having radially expandable fingers 84 operated by a tapered cam 85, is inserted into the part 70-1 and the wall of the neck section is pressed into the die cavities by expanding the fingers radially outward.

Fingers 84 have embossing parts 86 configured to the size and shape of lugs 35 and are adapted to mate with cavities 81. After lugs 35 are so formed, the fingers 84 are retracted, the punch 82 and die 80 separate, and the completed neck part 70-5 is removed. In this same station, the wing-like lower rim can be reshaped, as by further curling, preparatory for the seaming operation when the end is attached to a filled can body.

Alternately, using an auxiliary piece of equipment, the wing-like lower rim or seaming curl will be finish shaped, and lugs 35 will be formed at the same time, using rotary techniques. The part 70-5 is grasped in a rotating chuck 90 and rotated about a first axis 92 which coincides with the centerline of the upper neck section 25. Cooperating rotatable rolling (or ironing) tools, namely an outer anvil 94 rotating on an axis 95, and an inner die 96 rotating on an axis 97, are brought into contact with the wall of the neck section. The anvil and it cooperating die, and their respective rotary drives, are movable toward and away from the chuck/part axis 92 in a radial direction and in a longitudinal direction; thus these parts can be moved into and out of, and toward and away from the surfaces of, the upper neck section 25 of the chucked part 70-5. These rotary anvil 94 and die 96 tools have the male/female configurations of the lugs 35 formed thereon. When the anvil and die are engaged and rotated with the rotating part 70-5, the lug configurations are pressed into the wall of the upper neck section.

Thus, the present invention provides methods and apparatus for making the neck and hat member container end. The various punches, dies, and related equipment, associated with the progressive stations disclosed, form a means for performing the various steps described so as to manufacture the neck member and cooperating hat member in presses and related machines in a mass production, environment.

Figure 7:
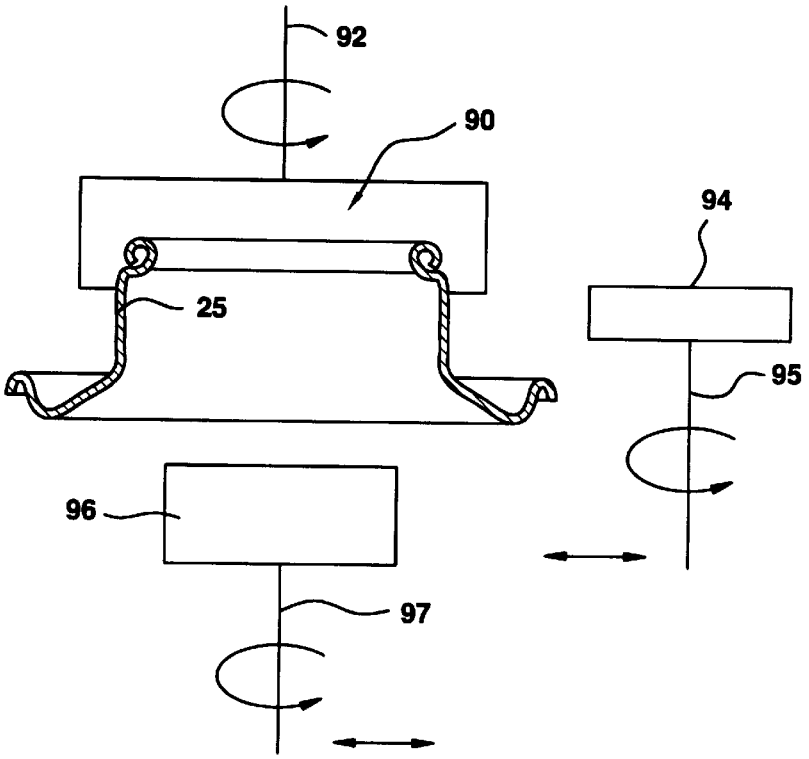
FIG. 7 is a schematic illustration of an alternate way of forming lugs on the neck section.

FIG. 7 illustrates deformed geometry of the hat or cap at 90 PSI, in comparison with approximate undeformed geometry, the deformation being due to application of external vertical axial load on the container due to direct stacking of a second container or can on top of another can (as in FIG. 1). Testing and computer modeling indicates the hat or cap will tend to lower to minimum position with doming still present in the hat. The seal 32 will tend to push further into the gap between hat member 12 and the external surfaces of the pouring opening, causing a tightening of the seal.

Figure 8:
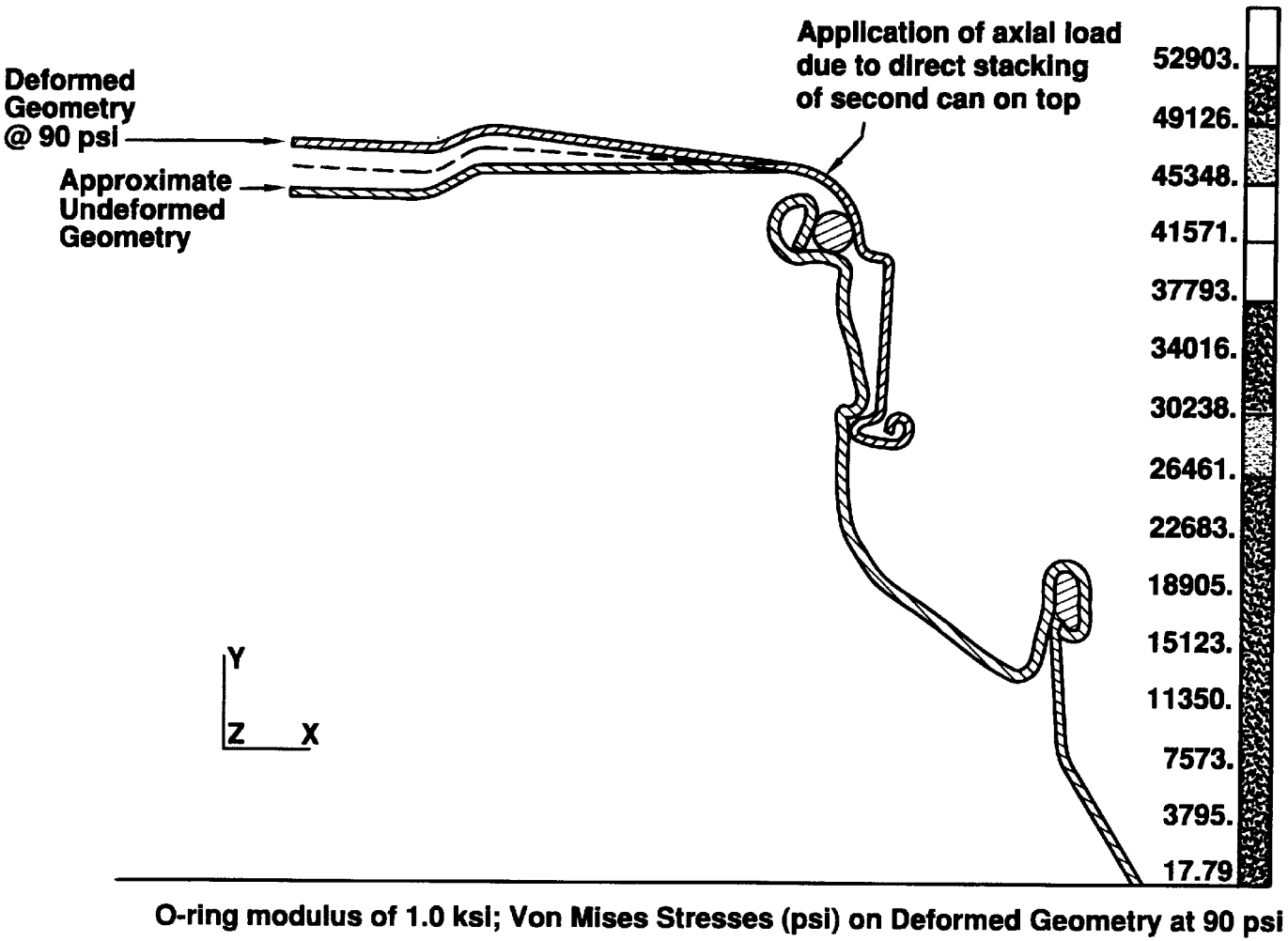
FIG. 8 is a diagram showing the effect of stacking of the containers on the cap and its seal.
Figure 9:
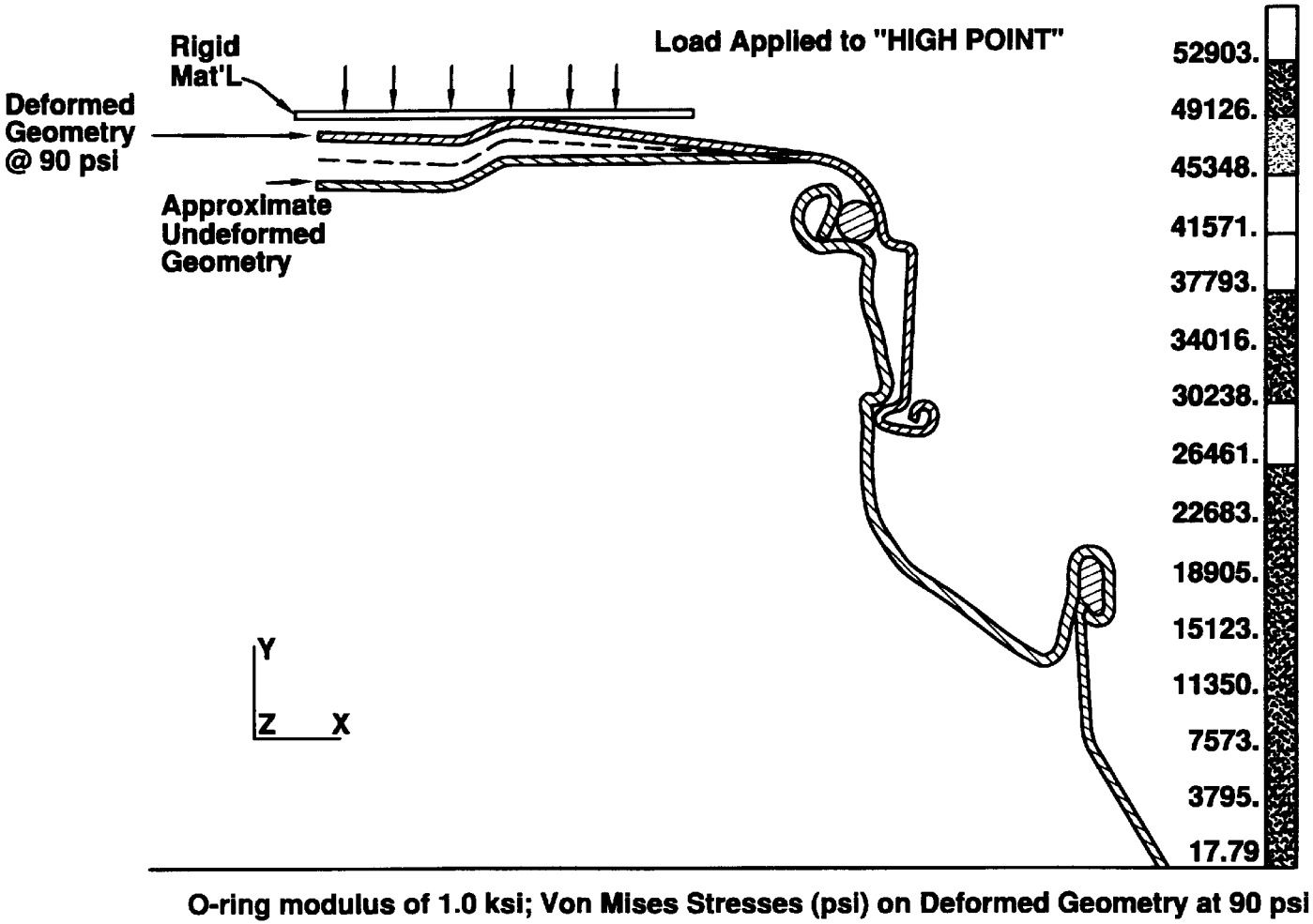
FIG. 9 is a diagram showing the effect of loading on the cap and its seal.

FIG. 8 shows deformed geometry of hat member 12 at 90 PSI, compared to approximate undeformed geometry of the hat member. The loading is applied to the center of the hat member and the hat member will tend to flatten due to the moment shown. Such deformation may cause some outward movement in the sides of the hat member (shown exaggerated). This could, potentially, decompress the O-ring seal somewhat, but even in such a lesser pressurized state there is built-in interference between the seal member, the upper neck region at dome, and the cap. Therefore, a container fitted with a seal according to this invention will not lose its sealing, although it may experience some lowering of the hat member as seen in the above described situation (FIG.7) in combination with flattening of the hat member.

While the methods herein described, and the forms of apparatus for carrying these methods into effect, constitute preferred embodiments of this invention, it is to be understood that the invention is not limited to these precise methods and forms of apparatus, and that changes may be made in either without departing from the scope of the invention, which is defined in the appended claims.

What is claimed is:

1. The method of manufacturing a container end including a neck member for seaming to a can body and a hat member forming with the neck member a resealable closure, comprising the steps of forming a neck member including a peripheral wing part adapted for seaming to a can body and a generally cylindrical upper neck part, forming an outward curl upon the upper neck part defining a pouring opening, forming a first set of lugs projecting outwardly of the upper neck part to a predetermined first diameter, and forming cam surfaces on the first set of lugs, forming an inverted generally cup-shaped hat member including a top panel and a rim depending from the top panel and an outward curl formed about the edge of the rim, forming a second set of lugs extending inwardly from the rim to a predetermined second diameter less than the diameter of the first set of lugs for interaction with the cam surfaces or the first set of lugs, on th neck member to urge the top panel against the outward curl surrounding the pour opening.

2. The method defined in claim 1, further comprising the steps of forming a seal member including a ring having an inner diameter sized to fit against the outward curl around the pour opening, placing the seal member within the hat member such that the ring presses against the outward curl on the pour opening when the lugs on the hat member are fully engaged with the lugs on the upper neck part.

3. Apparatus for manufacturing a container end including a neck member for seaming to a can body and a hat member forming with the neck member a resealable closure, said apparatus comprising means for forming a neck member including a peripheral wing part adapted for seaming to a can body and a generally cylindrical upper neck part, means for forming an outward curl upon said upper neck part to define a pouring opening, means for forming a first set of lugs projecting outwardly of said upper neck part to a predetermined first diameter, said first set of lugs including cam surfaces, means for forming an inverted generally cup-shaped hat member including a top panel and a rim depending from said top panel and an outward curl formed about the edge of said rim, means for forming a second set of lugs extending inwardly from said rim to a predetermined second diameter less than the diameter of said first set of lugs for interaction with said cam surfaces on said first set of lugs on said neck member to move said top panel against said outward curl surrounding said pour opening.

* * * * *